US011125225B2

(12) United States Patent
Beisel

(10) Patent No.: US 11,125,225 B2
(45) Date of Patent: Sep. 21, 2021

(54) MULTIPLE-PUMP VALVE MONITORING SYSTEM

(71) Applicant: HALLIBURTON ENERGY SERVICES, INC., Houston, TX (US)

(72) Inventor: Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 16/320,007

(22) PCT Filed: Aug. 31, 2016

(86) PCT No.: PCT/US2016/049619
§ 371 (c)(1),
(2) Date: Jan. 23, 2019

(87) PCT Pub. No.: WO2018/044289
PCT Pub. Date: Mar. 8, 2018

(65) Prior Publication Data

US 2019/0271305 A1 Sep. 5, 2019

(51) Int. Cl.
*F04B 51/00* (2006.01)
*F04B 1/053* (2020.01)
(Continued)

(52) U.S. Cl.
CPC ..... *F04B 51/00* (2013.01); *F04B 1/053* (2013.01); *F04B 9/045* (2013.01); *F04B 15/00* (2013.01);
(Continued)

(58) Field of Classification Search
CPC ..... F04B 2201/06–06062; F04B 51/00; F16K 37/0075–0091; G01M 13/00–003
See application file for complete search history.

(56) References Cited

U.S. PATENT DOCUMENTS 4,705,459 A 11/1987 Buisine et al.
6,882,960 B2 4/2005 Miller
(Continued)

FOREIGN PATENT DOCUMENTS

WO 2010136746 12/2010

OTHER PUBLICATIONS

International Patent Application No. PCT/US2016/049619 , "International Search Report and Written Opinion", dated May 22, 2017, 19 pages.

*Primary Examiner* — Devon C Kramer
*Assistant Examiner* — Thomas Fink
(74) *Attorney, Agent, or Firm* — Kilpatrick Townsend & Stockton LLP

(57) ABSTRACT

A monitoring system may include strain gauges and position sensors corresponding to multiple pressure pumps. The strain gauge for each pressure pump may measure the strain in a respective chamber of each pump. The position sensor for each pump may measure the position of a rotating member of each pump. The monitoring system may also include one or more computing devices for determining actuation delays associated with valves corresponding to the respective chamber of each pump using expected actuation points and actual actuation points of the valves. The computing devices may compare the actuation points for the valves of all of the pressure pumps to determine a condition of a valve in one of the pressure pumps.

19 Claims, 12 Drawing Sheets

(51) Int. Cl.

| | |
|---|---|
| ***F04B 9/04*** | (2006.01) |
| ***F04B 15/02*** | (2006.01) |
| ***F04B 23/06*** | (2006.01) |
| ***F04B 49/06*** | (2006.01) |
| ***F04B 53/10*** | (2006.01) |
| ***F04B 15/00*** | (2006.01) |

(52) U.S. Cl.
CPC ..... *F04B 15/02* (2013.01); *F04B 23/06* (2013.01); *F04B 49/065* (2013.01); *F04B 53/10* (2013.01); *F04B 2201/0201* (2013.01); *F04B 2201/12* (2013.01); *F04B 2205/03* (2013.01)

(56) References Cited

U.S. PATENT DOCUMENTS

| | | | | |
|---|---|---|---|---|
| 7,623,986 | B2 | 11/2009 | Miller | |
| 9,934,671 | B1 * | 4/2018 | Anderson | G08B 21/18 |
| 2004/0158419 | A1 | 8/2004 | Pearson et al. | |
| 2005/0025631 | A1 * | 2/2005 | Lake | F04B 51/00 417/63 |
| 2006/0228225 | A1 | 10/2006 | Rogers et al. | |
| 2007/0140869 | A1 * | 6/2007 | St. Michel | F04B 47/00 417/53 |
| 2009/0252620 | A1 * | 10/2009 | Lazzara | F04B 49/10 417/212 |
| 2013/0317750 | A1 * | 11/2013 | Hunter | E21B 47/00 702/6 |
| 2018/0230786 | A1 * | 8/2018 | Beisel | F04B 49/065 |

* cited by examiner

MULTIPLE-PUMP VALVE MONITORING SYSTEM

TECHNICAL FIELD

The present disclosure relates generally to pressure pumps for a wellbore and, more particularly (although not necessarily exclusively), to monitoring valves in multiple pressure pumps in a wellbore environment.

BACKGROUND

Pressure pumps may be used in wellbore treatments. For example, hydraulic fracturing (also known as "fracking" or "hydro-fracking") may utilize a pressure pump to introduce or inject fluid at high pressures into a wellbore to create cracks or fractures in downhole rock formations. Due to the high-pressured and high-stressed nature of the pumping environment, pressure pump parts may undergo mechanical wear and require frequent replacement. Frequently changing parts may result in additional costs for the replacement parts and additional time due to the delays in operation while the replacement parts are installed.

DETAILED DESCRIPTION

Figure 1A:
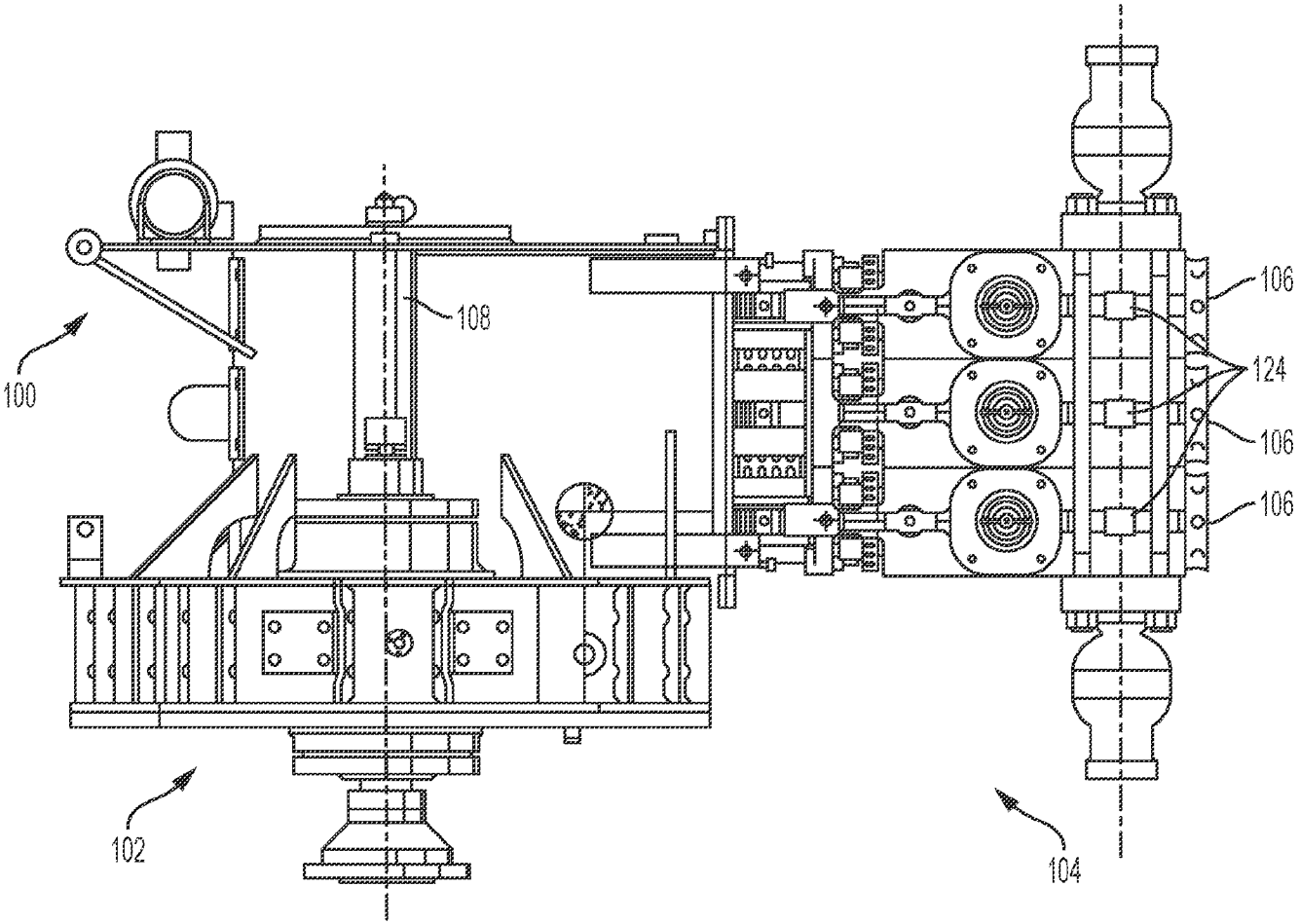
FIG. 1A is a cross-sectional, top view schematic diagram depicting an example of a pressure pump that may include a multiple-pump wellbore environment according to one aspect of the present disclosure.

Certain aspects and examples of the present disclosure relate to a monitoring system for determining and monitoring conditions across a spread of pressure pumps by monitoring and comparing the actuation of the valves using strain measurements. The spread of pressure pumps may include multiple pressure pumps collectively in fluid communication with an environment of a wellbore. In some aspects, the spread of pressure pumps may experience similar conditions to, collectively, pump fluid into the wellbore to fracture subterranean formations adjacent to the wellbore. In some aspects, a condition of the valve or pump may include a state affecting the performance of the valve or pump or other metric of the performance. The monitoring system may include one or more computing devices coupled to each of the pressure pumps in the spread. The computing devices may be coupled to the pressure pumps through a strain gauge and a position gauge located on each pump to, respectively, measure strain in a chamber of each pump and sense a position of one or more components of each pump. The computing devices may use strain measurements corresponding to the strain in the chamber of each pump to determine actuation points corresponding to the opening times and closing times of the valves in the chamber. The computing devices may correlate the actuation points for the valves with the position of the components of the respective pressure pumps to determine delays in the actuation of the valve. The actuation delays may correspond to a difference between the actual actuation points of the valves and the expected actuation points of the valves based on the position of the components of the pressure pumps associated with the valves. The actuation delays of the valves of the pressure pumps may be compared, collectively, to determine a range, or trend, in the performance of the valves across the spread of pressure pumps. Valves having actuation delays falling outside of the determined range may indicate a problem with the valve or the chamber or pressure pump in which the valve is positioned.

The range of delays determined for the actuation points of the valves in the spread of pressure pumps may correspond to an expected range of operation for the valve. In some aspects, a centralized processor according to some aspects may execute instructions to determine all possible valve-timing conditions and may diagnose the performance of a pressure pump including an outlier valve having actuation points outside of the range based on the comparison of the actuation delays. For example, the diagnosis may indicate a leak in the valve (e.g., represented by a delayed sealing), a failed valve (represented by no load up in the chamber of the pressure pump), or another condition of the corresponding pressure pump determinable from the valve-timing conditions.

In some aspects, a pressure pump without a monitoring system according to the present disclosure may require additional pump data that may be difficult to obtain to accurately determine ranges of normal operation for the valves. The pump data may include fluid system properties, pump properties (e.g., the effective modulus of each pressure pump, packing, valve inserts, etc.), and operations information (e.g., discharge pressure, discharge rate, etc.). Data such as the fluid system properties may be subject to significant changes during the course of a pumping operation using multiple pressure pumps and, thus, would require frequent verifications to consistently provide protection to critical pump components in the spread. Further, calibration runs may be necessary to characterize each pressure pump and a database would be needed to maintain performance data of each pressure pump across different pressures and rates. Comparing valve actuation points to similar pump valves performing similar operations may allow for savings of cost and labor in the information gathering and calculations otherwise necessary to determine expected ranges for the operation of the valves. Since the fluid system properties, pump properties, and operations information may similarly affect actuations of similarly operating valves, the centralized processor, according to some aspects, may reliably determine the ranges by comparing the similarly operating valves during operation of the pressure pump. Similarly, the statistical evaluation of the valve operations is aided by a large data set as each pressure pump in the spread may include multiple chambers with valves that may be used in determining an accurate range of expected valve performance.

Figure 1B:
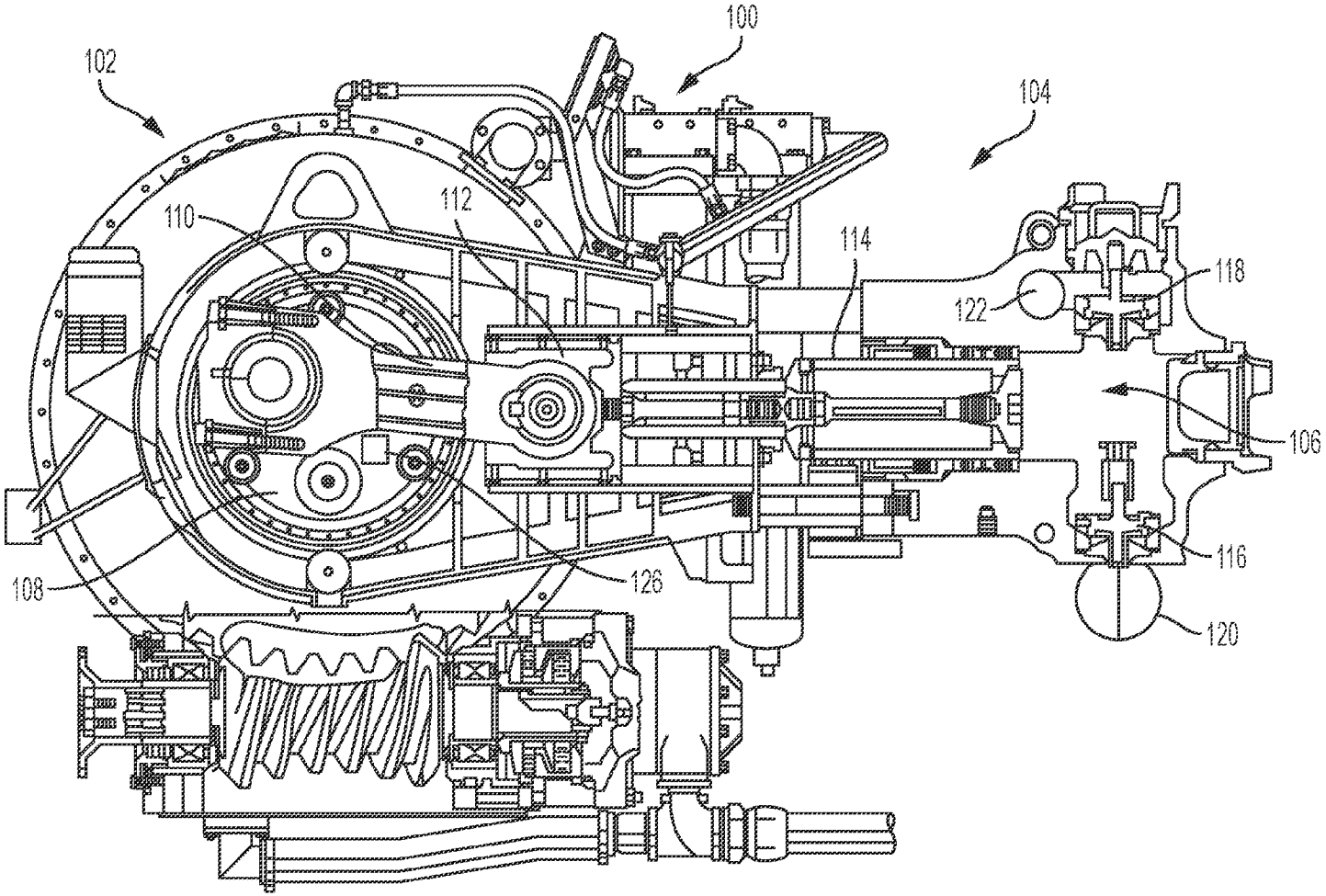
FIG. 1B is a cross-sectional, side view schematic diagram depicting the pressure pump of FIG. 1A according to one aspect of the present disclosure.

FIGS. 1A and 1B show a pressure pump 100 that may utilize a valve monitoring system according to some aspects of the present disclosure. The pressure pump 100 may be any positive displacement pressure pump. The pressure pump 100 may include a power end 102 and a fluid end 104. The power end 102 may be coupled to a motor, engine, or other prime mover for operation. The fluid end 104 includes three chambers 106 for receiving and discharging fluid flowing through the pressure pump 100. Although FIG. 1A shows three chambers in the pressure pump 100, the pressure pump 100 may include more or less chambers, including one chamber where there are multiple pressure pumps, without departing from the scope of the present disclosure.

The pressure pump 100 may also include a rotating assembly. The rotating assembly may include a crankshaft 108, one or more connecting rods 110, a crosshead 112, plungers 114, and related elements (e.g., pony rods, clamps, etc.). The crankshaft 108 may be positioned on the power end 102 of the pressure pump 100 and may be mechanically connected to a plunger 114 in a chamber 106 of the pressure pump via the connecting rod 110 and the crosshead 112. The power end 102 may include an external casing or crankcase. The crankshaft 108 may cause plungers 114 located in each chamber 106 to displace any fluid in the chambers 106. Each chamber 106 of the pressure pump 100 may include a separate plunger 114, each plunger 114 in each chamber 106 mechanically connected to the crankshaft 108 via the connecting rod 110 and the crosshead 112. Each chamber 106 may include a suction valve 116 and a discharge valve 118 for absorbing fluid into the chamber 106 and discharging fluid from the chamber 106, respectively. The fluid may be absorbed into and discharged from the chamber 106 in response to a movement of the plunger 114 in the corresponding chamber 106. Based on the mechanical coupling of the crankshaft 108 to the plunger 114 in the chamber 106, the movement of the plunger 114 in each chamber 106 may be directly related to the movement of the crankshaft 108.

A suction valve 116 and a discharge valve 118 may be included in each chamber 106 of the pressure pump 100. In some aspects, the suction valve 116 and the discharge valve 118 may be passive valves. As the plunger 114 operates in each chamber 106, the plunger 114 may impart motion and pressure to the fluid in the chamber 106 by direct displacement. The suction valve 116 and the discharge valve 118 in each chamber 106 may open or close based on the displacement of the fluid in the chamber 106 by the operation of the plunger 114. For example, the suction valve 116 may be opened during a recession of the plunger 114 to provide absorption of fluid from outside of the chamber 106 into the chamber 106. As the plunger 114 is withdrawn from the chamber 106, a pressure differential may be created to open the suction valve 116 to allow fluid to enter the chamber 106. In some aspects, the fluid may be absorbed into each chamber 106 from a corresponding inlet manifold 120. Fluid already in each chamber 106 may move to fill the space where the plunger 114 was located in the chamber 106. The discharge valve 118 may be closed during this process.

The discharge valve 118 may be opened as the plunger 114 moves forward (or reenters) the chamber 106. As the plunger 114 moves further into the chamber 106, the fluid may be pressurized. The suction valve 116 may be closed during this time to allow the pressure on the fluid to force the discharge valve 118 to open and discharge fluid from the chamber 106. In some aspects, the discharge valve 118 in each chamber 106 may discharge the fluid into a corresponding discharge manifold 122. The loss of pressure inside the chamber 106 may allow the discharge valve 118 to close and the cycle may restart. Together, the suction valves 116 and the discharge valves 118 in each chamber 106 may operate to provide the fluid flow of the pressure pump 100 in a desired direction. The pump process may include a measurable amount of pressure and stress in each chamber 106, the stress resulting in strain to the chamber 106 or fluid end 104 of the pressure pump 100. In some aspects, the strain may be used to determine actuation of the suction valve 116 and the discharge valve 118 in the chamber 106.

In some aspects, a monitoring system according to some aspects of the present disclosure may include a subsystem including one or more measuring devices coupled to the pressure pump 100 to gauge the strain and determine actuation of the suction valve 116 and the discharge valve 118 in the chamber 106. For example, a subsystem of the monitoring system may include strain gauges positioned on an external surface of the fluid end 104 to gauge strain in the chambers 106. Blocks 124 in FIG. 1A show an example placement for the strain gauges that may be included in the monitoring system. In some aspects, the subsystem may include a separate strain gauge to monitor strain in each chamber 106 of the pressure pump 100. In some aspects, a subsystem according to some aspects may also include one or more position sensors for sensing the position of the crankshaft 108. Measurements of the crankshaft position may allow the monitoring system to determine the position of the plungers 114 in the respective chambers 106. A position sensor of the monitoring system may be positioned on an external surface of the pressure pump 100. Block 126 shows an example placement of a position sensor on an external surface of the power end 102 to sense the position of the crankshaft 108. In some aspects, measurements from the position sensor may be correlated with the measurements from the strain gauges to determine actuation delays corresponding to the valves 116, 118 in each chamber 106 of the pressure pump 100 for identifying cavitation in the fluid end 104.

In some aspects, the pressure pump 100 may represent each pump in a spread of pressure pumps used to complete a pumping operation (e.g., hydraulic fracturing) in a wellbore environment. Although the pressure pump 100 is shown to have multiple chambers 106, a pressure pump in the spread of pressure pumps may have any number of chambers, including one, using valves to allow and discharge fluid into and out of the chambers, respectively. The chambers 106 in each pressure pump may be identical or similar in dimension or operation, or may have different dimensions or operations.

Figure 2:
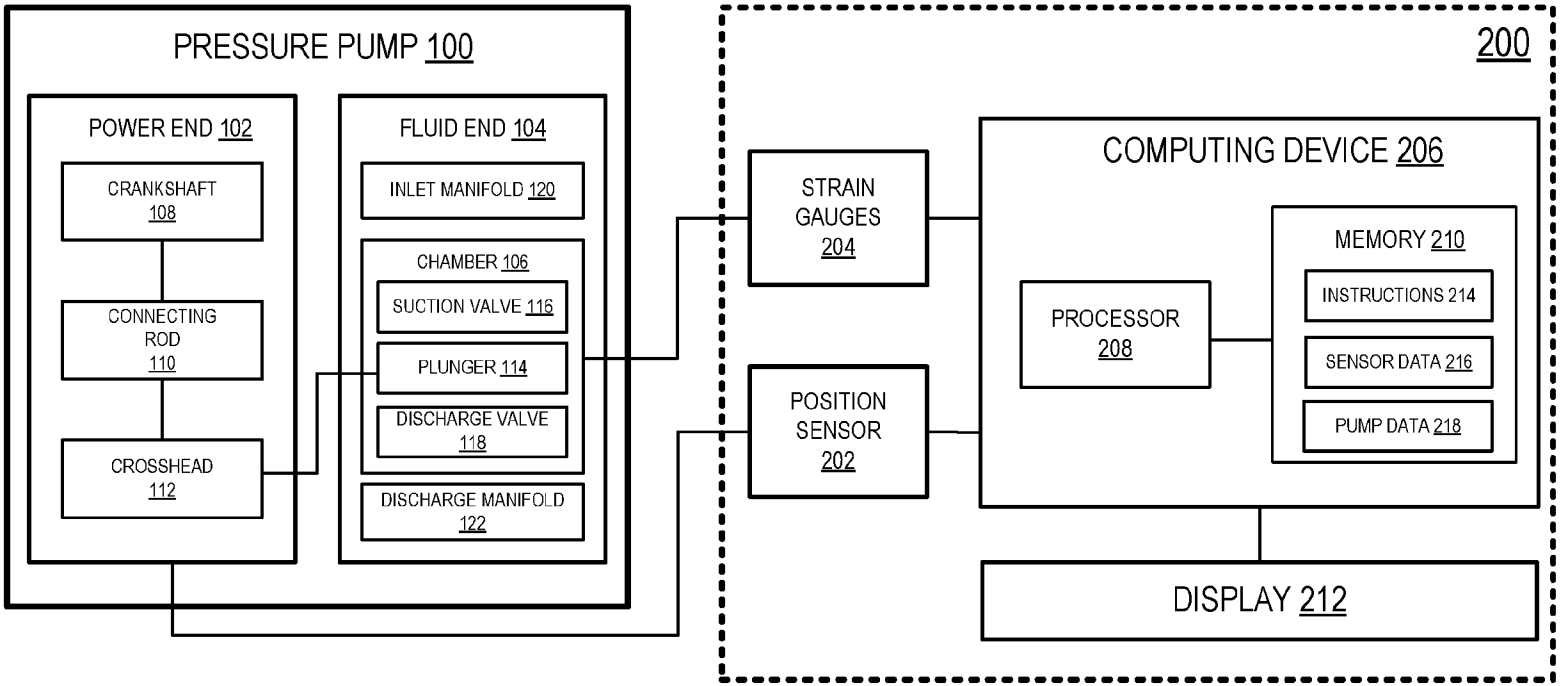
FIG. 2 is a block diagram depicting a monitoring subsystem for a pressure pump according to one aspect of the present disclosure.

FIG. 2 is a block diagram showing an example of a monitoring subsystem 200 coupled to the pressure pump 100. The monitoring subsystem 200 may include a position sensor 202, strain gauges 204, and a computing device 206. The position sensor 202 and the strain gauges 204 may be coupled to the pressure pump 100. The position sensor 202 may include a single sensor or may represent an array of sensors. The position sensor 202 may be a magnetic pickup sensor capable of detecting ferrous metals in close proximity. The position sensor 202 may be positioned on the power end 102 of the pressure pump 100 for determining the position of the crankshaft 108. In some aspects, the position sensor 202 may be placed proximate to a path of the crosshead 112. The path of the crosshead 112 may be directly related to a rotation of the crankshaft 108. The position sensor 202 may sense the position of the crankshaft 108 based on the movement of the crosshead 112. In other aspects, the position sensor 202 may be placed on a crankcase of the power end 102 as illustrated by block 126 in FIG. 1A. The position sensor 202 may determine a position of the crankshaft 108 by detecting a bolt pattern of the position sensor 202 as it rotates during operation of the pressure pump 100. In each aspect, the position sensor 202 may generate a signal representing the position of the crankshaft 108 and transmit the signal to the computing device 206.

The strain gauges 204 may be positioned on the fluid end 104 of the pressure pump 100. The strain gauge 204 may include one or more gauges for determining strain in each chamber 106 of the pressure pump 100. In some aspects, the monitoring subsystem 200 may include a strain gauge 204 for each chamber 106 of the pressure pump 100 to determine strain in each of the chambers, respectively. In some aspects, the strain gauges 204 may be positioned on an external surface of the fluid end 104 of the pressure pump 100 in a position subject to strain in response to stress in the corresponding chamber 106. For example, each of the strain gauges 204 may be positioned on a section of the fluid end 104 in a manner such that when the chamber 106 corresponding to each strain gauge 204 loads up, strain may be present at the location of the strain gauge 204. Placement of the strain gauges 204 may be determined based on engineering estimations, finite element analysis, or by some other analysis. For example, finite element analysis may determine that strain in a chamber 106 may be directly over a plunger bore of that chamber 106 during load up. One of the strain gauge 204 may be placed on an external surface of the pressure pump 100 in a location directly over the plunger bore corresponding to the chamber 106 as illustrated by blocks 124 in FIG. 1A to measure strain in the chamber 106. The strain gauge 204 may generate a signal representing strain in the chamber 106 and transmit the signal to the computing device 206.

The computing device 206 may be coupled to the position sensor 202 and the strain gauge 204 to receive the generated signals from the position sensor 202 and the strain gauge 204. The computing device 206 may include a processor 208 and a memory 210. The processor and the memory 210 may be connected by a bus or other suitable connecting means. In some aspects, the monitoring subsystem 200 may also include a display unit 212. The processor 208 may execute instructions 214 including one or more operations for determining the condition of the valves 116, 118 of the pressure pump 100. The instructions 214 may be stored in the memory 210 accessible to the processor 208 to allow the processor 208 to perform the operations. The processor 208 may include one processing device or multiple processing devices. Non-limiting examples of the processor 208 may include a Field-Programmable Gate Array ("FPGA"), an application-specific integrated circuit ("ASIC"), a microprocessor, etc.

The non-volatile memory 210 may include any type of memory device that retains stored information when powered off. Non-limiting examples of the memory 210 may include electrically erasable and programmable read-only memory ("EEPROM"), a flash memory, or any other type of non-volatile memory. In some examples, at least some of the memory 210 may include a medium from which the processor 208 can read the instructions 214. A computer-readable medium may include electronic, optical, magnetic or other storage devices capable of providing the processor 208 with computer-readable instructions or other program code (e.g., instructions 214). Non-limiting examples of a computer-readable medium include (but are not limited to) magnetic disks(s), memory chip(s), ROM, random-access memory ("RAM"), an ASIC, a configured processor, optical storage, or any other medium from which a computer processor can read the instructions 214. The instructions 214 may include processor-specific instructions generated by a compiler or an interpreter from code written in any suitable computer-programming language, including, for example, C, C++, C #, etc.

In some examples, the computing device 206 may determine an input for the instructions 214 based on sensor data 216 from the position sensor 202 or the strain gauges 204, data input into the computing device 206 by an operator, or other input means. For example, the position sensor 202 or the strain gauges 204 may measure a parameter associated with the pressure pump 100 (e.g., the position of the crankshaft 108, strain in the chamber 106) and transmit associated signals to the computing device 206. The computing device 206 may receive the signals, extract data from the signals, and store the sensor data 216 in memory 210. In additional aspects, the computing device 206 may determine an input for the instruction 214 based on pump data 218 stored in the memory 210 in response to previous determinations by the computing device 206. For example, the processor 208 may execute instructions 214 for determining actuation points and actuation delays for the valves 116, 118 in the pressure pump 100 and may store the results as pump data 218 in the memory 210 for use in further pressure pump 100 and monitoring subsystem 200 operations (e.g., calibrating the pressure pump 100, determining conditions in one or more chambers 106 of the pressure pump 100, etc.).

In some aspects, the computing device 206 may generate interfaces associated with the sensor data 216 or pump data 218, and information generated by the processor 208 therefrom, to be displayed via a display unit 212. The display unit 212 may be coupled to the processor 208 and may include any CRT, LCD, OLED, or other device for displaying interfaces generated by the processor 208. In some aspects, the computing device 206 may also generate an alert or other communication of the performance of the pressure pump 100 based on determinations by the computing device 206 in addition to the graphical interfaces. For example, the display unit 212 may include audio components to emit an audible signal when an ill condition is present in the pressure pump 100.

Figure 3:
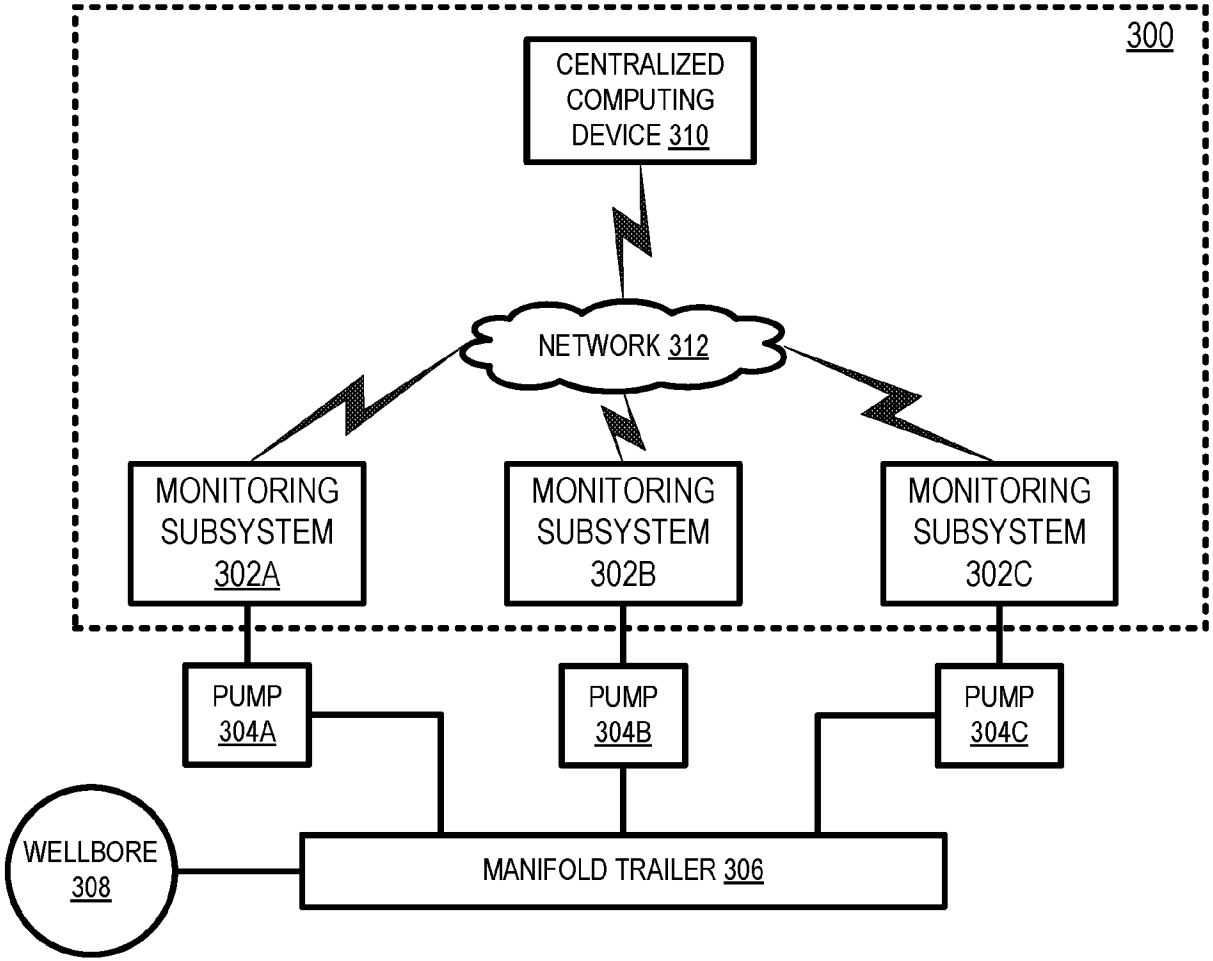
FIG. 3 is a block diagram depicting a multiple-pump monitoring system according to one aspect of the present disclosure.

FIG. 3 is a block diagram of a multiple-pump monitoring system 300 according to some aspects of the present disclosure. The multiple-pump monitoring system 300 includes monitoring subsystems 302A, 302B, 302C. In some aspects, the monitoring subsystem 200 of FIG. 2 may represent each of the monitoring subsystems 302A, 302B, 302C. For example, each of the monitoring subsystems may include a processor and a memory (corresponding to the processor 208 and the memory 210 of the monitoring subsystem 200 of FIG. 2) for receiving and processing information from pressure pumps 304A, 304B, 304C, respectively. In some aspects, the pressure pump 100 of FIGS. 1-2 may represent each of the pumps 304A, 304B, 304C. For example, each of the pumps 304A, 304B, 304C may include one or more position gauges and strain gauges (corresponding to the position sensor 202 and the strain gauges 204 of FIG. 2) for obtaining measurements used by the respective processors of the monitoring subsystems 302A, 302B, 302C. The pumps 304A, 304B, 304C are fluidly coupled to a manifold trailer 306. The manifold trailer 306 may include a trailer, truck, or other apparatus including one or more pump manifolds for receiving, organizing, or distributing fluids to a wellbore 308. The manifold trailer 306 may be coupled to the pumps 304A, 304B, 304C by flow lines that supply fluid from each of the pumps 304A, 304B, 304C to the manifold trailer 306. The manifold trailer 306 may also include one or more manifold outlets from which the fluids may flow to the wellbore 308 via additional flow lines.

In some aspects, the pumps 304A, 304B, 304C may supply fluid to the wellbore 308 collectively through the manifold trailer 306 for use in hydraulic fracturing operations. Subsequent to the fluid passing through the chambers 106 of each pressure pump 304A, 304B, 304C and into the manifold trailer 306, the fluid may be injected into the wellbore 308 at a high pressure to break apart or otherwise fracture rocks and other formations adjacent to the wellbore 308 to stimulate a production of hydrocarbons. The monitoring subsystems 302A, 302B, 302C for the pumps 304A, 304B, 304C, respectively, may monitor the suction valves 116 and the discharge valves 118 in each chamber 106 of the pump 304A, 304B, 304C to determine when to halt the fracturing process for maintenance of the corresponding pump 304A, 304B, 304C. Although hydraulic fracturing is described here, the pumps 304A, 304B, 304C may be used for any process or environment requiring multiple positive displacement pressure pumps.

The monitoring subsystems 302A, 302B, 302C are coupled to a centralized computing device 310 via a network 312. In some aspects, the network 312 may include wireless or wired connections suitable to transmit data between the monitoring subsystems 302A, 302B, 302C and the centralized computing device 310. For example, data received, analyzed generated by the processors of the monitoring subsystems 302A, 302B, 302C corresponding to each of the pumps 304A, 304B, 304C, respectively, may be transmitted to the centralized computing device 310 via the network 312. Although three monitoring subsystems 302A, 302B, 302C are depicted for three pumps 304A, 304B, 304C, a multiple-pump monitoring system 300 may include two monitoring subsystems coupled to two pumps respectively, or more than three monitoring subsystems coupled to more than three pumps, respectively. For example, a first monitoring subsystem may be coupled to a first pump having multiple chambers that are similar in dimensions and operations, and a second monitoring subsystem may be coupled to a second pump having at least one chamber similar in dimensions and operations to the multiple chambers of the first pump. In additional and alternative aspects, the centralized processor 400 may be coupled to each of the pumps 304A, 304B, 304C via the network 312 directly without an intermediary monitoring subsystem without departing from the scope of the present disclosure.

Figure 4:
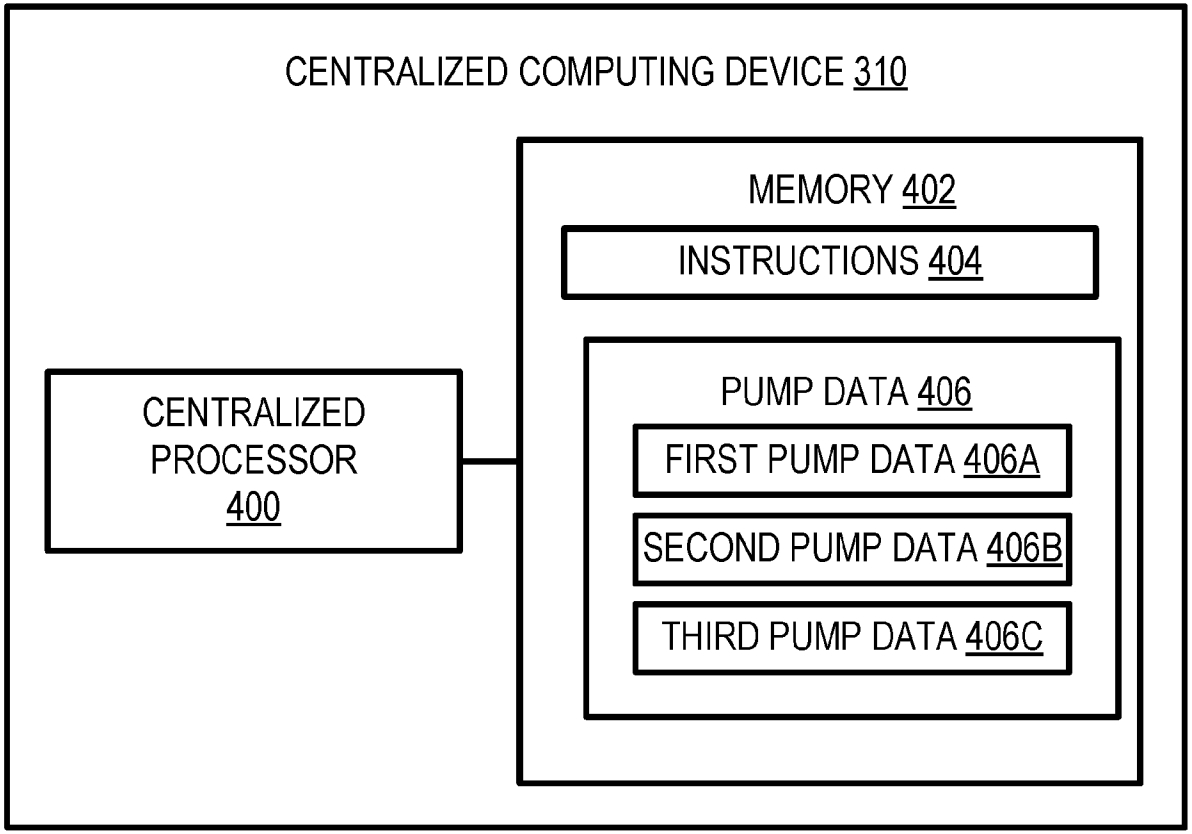
FIG. 4 is a block diagram depicting the centralized computing device for the multiple-pump monitoring system of FIG. 3 according to one aspect of the present disclosure.

FIG. 4 is a block diagram depicting the centralized computing device 304 for the multiple-pump monitoring system 300 of FIG. 3 according to one aspect of the present disclosure. The centralized computing device 304 includes a centralized processor 400 and a memory 402. In some aspects, the centralized processor 400 and the memory 402 may be connected by a bus to allow the centralized processor 400 to execute instructions 404 including one or more operations for determining the condition of valves across the spread of pumps 304A, 304B, 304C. The instructions 404 may be stored in the memory 402 and may be accessible to the processor 208 to allow the processor 208 to perform the operations. The processor 208 may include one processing device or multiple processing devices. The centralized processor 400 may be of a same or different type of processing device as the processor included in each monitoring subsystem 302A, 302B, 302C in FIG. 3 (represented by the processor 208 of the monitoring subsystem 200 of FIG. 2). Similarly, the memory 402 may be of the same or different type of non-volatile memory device as the memory included in each monitoring subsystem 302A, 302B, 302C in FIG. 3 (represented by the memory 210 of the monitoring subsystem 200 of FIG. 2). In some aspects, the memory 402 may include a computer-readable medium from which the centralized processor 400 can read the instructions 404. A computer-readable medium may include electronic, optical, magnetic or other storage devices capable of providing the centralized processor 400 with computer-readable instructions or other program code (e.g., instructions 404).

In some aspects, the centralized processor 400 of the centralized computing device 304 may determine an input for the instructions 404 based on pump data 406 corresponding to each of the pumps 304A, 304B, 304C in the multiple-pump monitoring system 300. For example, the pump data may include first pump data 406A, second pump data 406B, and third pump data 406C corresponding to data obtained from the pumps 304A, 304B, 304C, respectively. In some aspects, the centralized processor 400 may execute instructions 404 to determine a range of delays in the actuation of valves corresponding to each of the pumps 304A, 304B, 304C coupled to the multiple-pump monitoring system 300. For example, the centralized computing device 304 may receive, via the network 312, actuation points or actuation delays for the valves in the pumps 304A, 304B, 304C determined by the processor of each monitoring subsystem 302A, 302B, 302C, respectively, and stored as pump data 406. The centralized processor 400 may execute instructions 404 to aggregate the pump data 406A, 406B, 406C corresponding to the pumps 304A, 304B, 304C, respectively, and may determine a range in which all or a substantially majority of the actuation delays corresponding to a majority of the valves of the pumps 304A, 304B, 304C collectively trend through a cycle of fluid entering and exiting the chamber. The instructions 404 may also be executed by the centralized processor 400 to cause the centralized processor 400 to determine valves having actuation delays falling outside of the range, and may identify a condition of the valve based on the trend or other comparison of the actuation delays for the valves of the 304A, 304B, 304C.

FIGS. 5-9 describe determining the actuation delays of valves in the pressure pump 100 by the monitoring subsystem 200 of FIG. 2. Although this implementation, and the corresponding data, is described with respect to the pressure pump 100 and the monitoring subsystem 200, the determination may similarly be made by each monitoring subsystem 200 in the multiple-pump monitoring system 300 of FIG. 3 without departing from the scope of the present disclosure.

Figure 5:
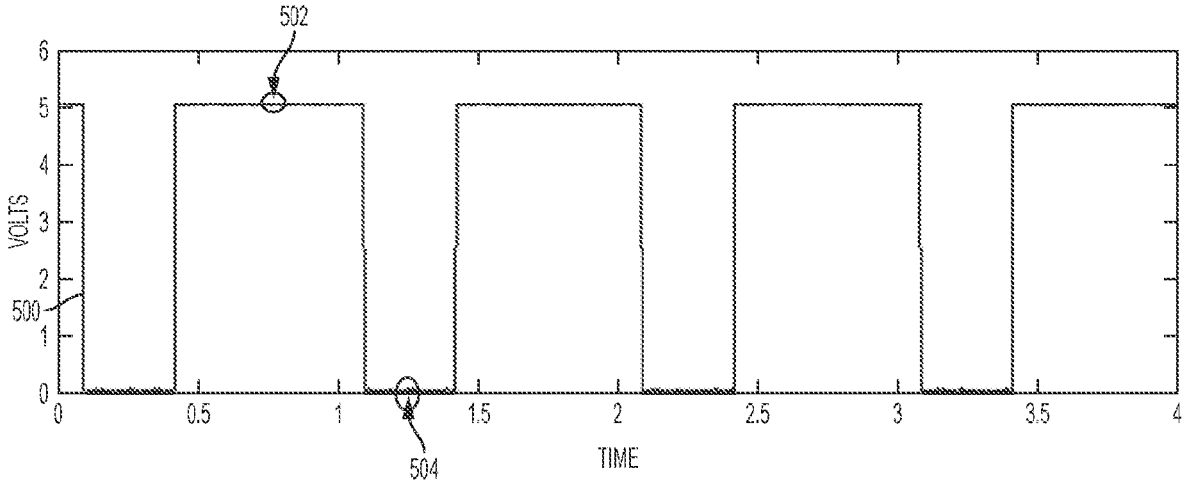
FIG. 5 is a signal graph depicting an example of a signal generated by a position sensor of the monitoring subsystem of FIG. 2 according to one aspect of the present disclosure.
Figure 6:
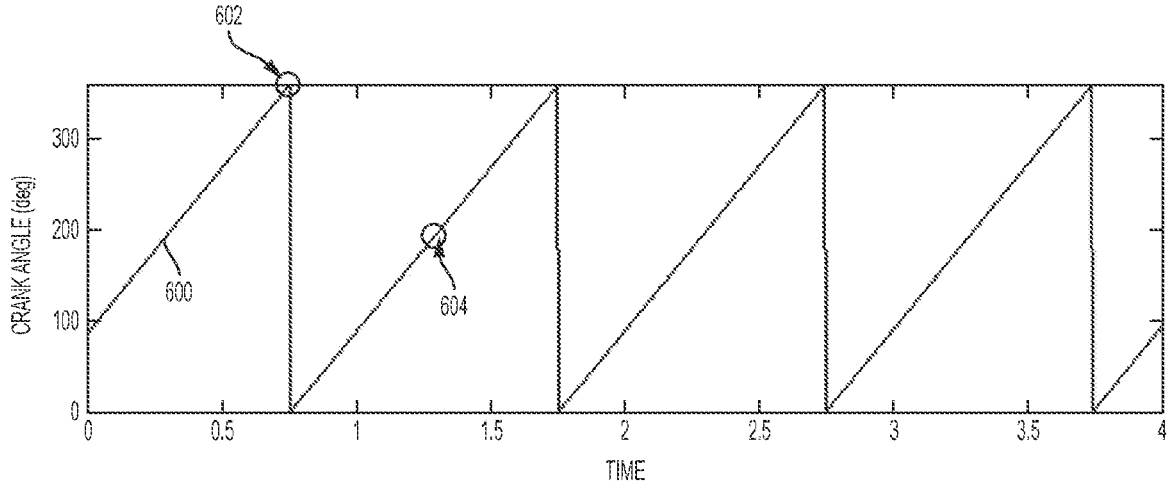
FIG. 6 is a signal graph depicting an example of another signal generated by a position sensor of the monitoring subsystem of FIG. 2 according to one aspect of the present disclosure.

FIGS. 5 and 6 show position signals 500, 600 generated by the position sensor 202 of FIG. 2 during operation of the crankshaft 108 of the pressure pump 100 of FIG. 1. In some aspects, the position signals 500, 600 may be shown on the display unit 212 in response to generation of graphical representation of the position signals 500, 600 by the computing device 206. FIG. 5 shows a position signal 500 displayed in volts over time (in seconds). The position signal 500 may be generated by the position sensor 202 coupled to the power end 102 of the pressure pump 100 and positioned in a path of the crosshead 112. The position signal 500 may represent the position of the crankshaft 108 over the indicated time as the crankshaft 108 operates to cause the plungers 114 to move in their respective chambers 106. The mechanical coupling of the plungers 114 to the crankshaft 108 may allow the computing device 206 to determine a position of the plungers 114 relative to the position of the crankshaft 108 based on the position signal 500. In some aspects, the computing device 206 may determine plunger-position reference points 502, 504, 602, 604 based on the position signal 500 generated by the position sensor 202. For example, the processor 208 may determine dead center positions of the plungers 114 based on the position signal 500. The dead center positions may include the position of each plunger 114 in which it is farthest from the crankshaft 108, known as the top dead center. The dead center positions may also include the position of each plunger 114 in which it is nearest to the crankshaft 108, known as the bottom dead center. The distance between the top dead center and the bottom dead center may represent the length of a full stroke of the plungers 114 operating in a chamber 106 of the pressure pump 100. In some aspects, the position of the plunger may allow an expected actuation point of the valves in the chamber 106 corresponding to the plunger 114. For example, a valve may be expected to open when the plunger is nearest to the crankshaft 108 and close when the plunger is farthest from the crankshaft 108.

In FIG. 5, the top dead center is represented by reference point 502 and the bottom dead center is represented by reference point 504. In some aspects, the processor 208 may determine the reference points 502, 504 by correlating the position signal 500 with a known ratio or other equation or expression representing the relationship between the movement of the crankshaft 108 and the movement of the plungers 114 (e.g., the mechanical correlations of the crankshaft 108 to the plungers 114 based on the mechanical coupling of the crankshaft 108 to the plungers 114). The computing device 206 may determine the top dead center and bottom dead center based on the position signal 500 or may determine other plunger-position reference points to determine the position of the plunger in each chamber 106 over the operation time of the pressure pump 100.

FIG. 6 shows a position signal 600 displayed in degrees over time (in seconds). The degree value may represent the angle of the crankshaft 108 during operation of the crankshaft 108 or pressure pump 100. In some aspects, the position signal 600 may be generated by the position sensor 202 located on a crankcase of the crankshaft 108. The position sensor 202 may generate the position signal 600 based on a bolt pattern of the position sensor 202 as it rotates in response to the rotation of the crankshaft 108 during operation. Similar to the position signal 500 shown in FIG. 5, the computing device 206 may determine plunger-position reference points 502, 504, 602, 604 based on the position signal 600. The reference points 602, 604 in FIG. 6 represent the top dead center and bottom dead center of the plungers 114 during operation of the pressure pump 100. Although a bolt pattern is used to generate the position signal 600 in FIG. 6, other suitable means for determining the position of the crankshaft 108 or other rotating member in the power end 102 may be identified without departing from the scope of the present disclosure.

Figure 7:
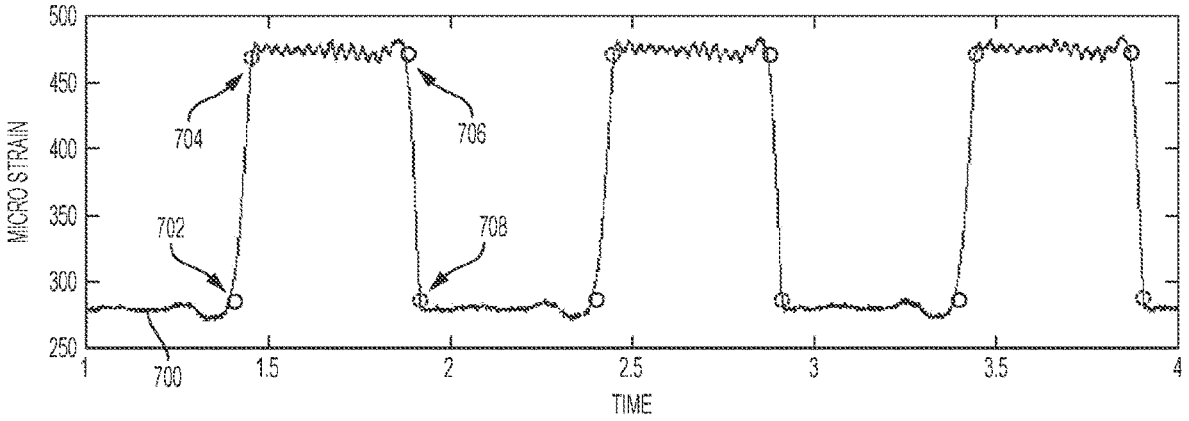
FIG. 7 is a signal graph depicting an example of a signal generated by a strain gauge of the monitoring subsystem of FIG. 2 according to one aspect of the present disclosure.

FIG. 7 shows a raw strain signal 700 generated by the strain gauge 204 coupled to the fluid end 104 of the pressure pump 100 and positioned on an external surface of the fluid end 104. The strain signal 700 may represent strain measured by the strain gauge 204 in a chamber 106 of the pressure pump 100. A monitoring subsystem 200 may include a strain gauge 204 for each chamber 106 of the pressure pump 100. Each strain gauge 204 may generate a strain signal 700 corresponding to the chamber 106 for which it is measuring strain. In some aspects, the computing device 206 may determine the actuation points 702, 704, 706, 708 of the suction valve 116 and the discharge valve 118 for each chamber 106 based on the strain signal 700 for each chamber 106. In other aspects, the computing device 206 may determine the actuation points 702, 704, 706, 708 of the suction valve 116 and the discharge valve 118 for only one chamber 106 in the pressure pump 100. The actuation points 702, 704, 706, 708 may represent the point in time where the suction valve 116 and the discharge valve 118 in a chamber 106 opens and closes.

The computing device 206 may execute the instructions 214 stored in the memory 210 and including signal-processing algorithms to determine the actuation points 702, 704, 706, 708. For example, the computing device 206 may execute instruction 214 to determine the actuation points 702, 704, 706, 708 by determining discontinuities in the strain signal 700 of each chamber 106. The stress in the chambers 106 may change during the operation of the suction valves 116 and the discharge valves 118 to cause discontinuities in the strain signal 700 for a chamber 106 during actuation of the valves 116, 118 in the chamber 106. The computing device 206 may identify the discontinuities as the opening and closing of the valves 116, 118 in the chamber 106. In one example, the strain in a chamber 106 may be isolated to the fluid in the chamber 106 when the suction valve 116 is closed. The isolation of the strain may cause the strain in the chamber 106 to load up until the discharge valve 118 is opened. When the discharge valve 118 is opened, the strain may level until the discharge valve 118 is closed, at which point the strain may unload until the suction valve 116 is reopened. The discontinuities may be present when the strain signal 700 shows a sudden increase or decrease in value corresponding to the actuation of the valves 116, 118. Although discontinuities are described for determining the actuation points 702, 704, 706, 708, the actuation points 702, 704, 706, 708 may be determined using other suitable means for analyzing the position of a rotating member of the pump 100.

In FIG. 7, actuation point 702 represents a suction valve 116 closing. Actuation point 704 represents a discharge valve 118 opening. Actuation point 706 represents the discharge valve 118 closing. Actuation point 708 represents the suction valve 116 opening to resume the cycle of fluid into and out of the chamber 106 in which the valves 116, 118 are located. In some aspects, the computing device 206 may cause the display unit 212 to display the strain signal 700 and the actuation points 702, 704, 706, 708 as shown in FIG. 7 for each chamber 106 of the pressure pump 100. The exact magnitudes of strain in a chamber 106 as determined by the corresponding strain gauge 204 may not be required for determining the actuation points 702, 704, 706, 708 for the valves 116, 118 in the chamber 106. The computing device 206 may determine the actuation points 702, 704, 706, 708 based on the strain signal 700 corresponding to each chamber 106 providing a characterization of the loading and unloading of the strain in the chamber 106. In some aspects, the actuation points 702, 704, 706, 708 may be cross-referenced with the position signals 500, 600 to determine an actual position of the plunger 114 at the time of valve actuation.

Figure 8:
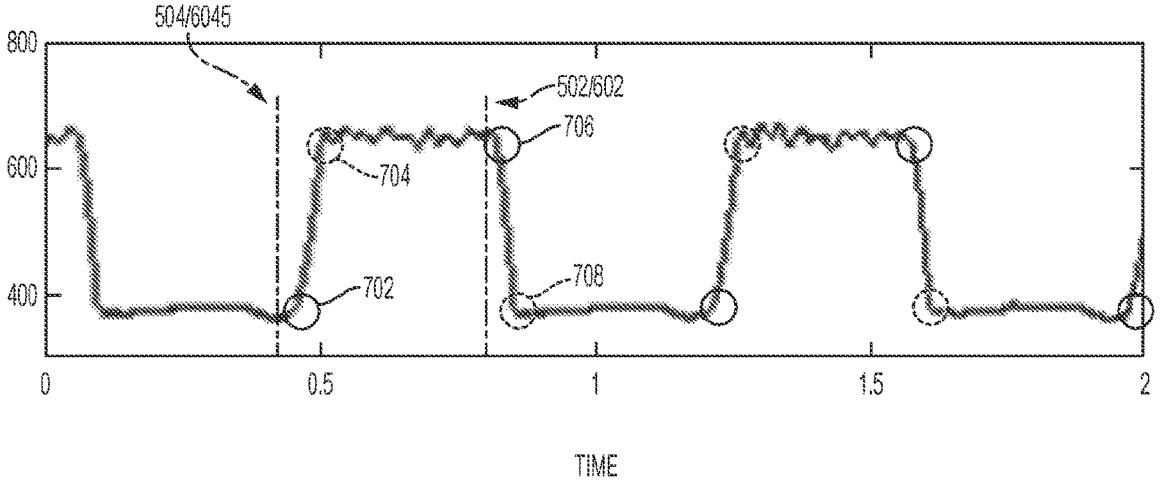
FIG. 8 is a signal graph depicting actuation points of a suction valve and a discharge valve relative to the strain signal of FIG. 7 and a plunger position according to one aspect of the present disclosure.
Figure 9:
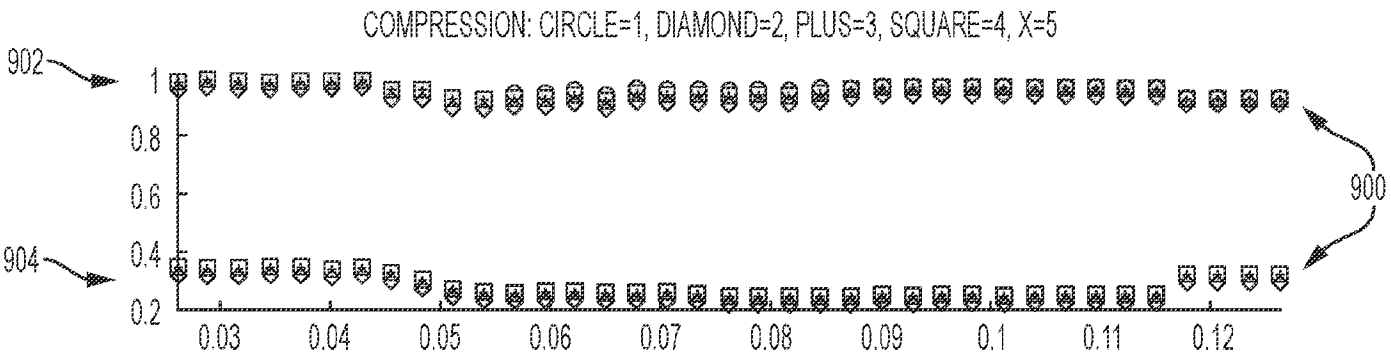
FIG. 9 is a dual plot graph depicting symbols representing actuation delays of suction valves and discharge valves in each chamber of a pressure pump in a multiple-pump wellbore environment according to one aspect of the present disclosure.
Figure 9:
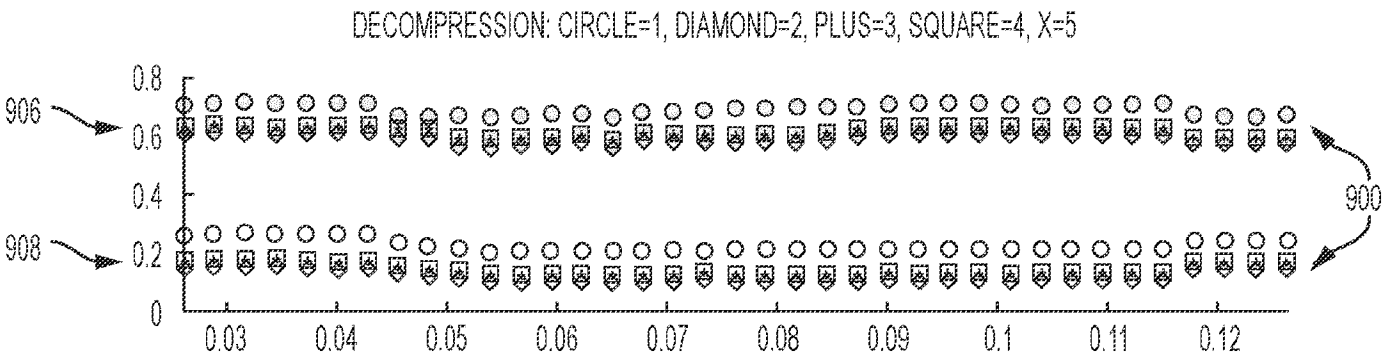

FIGS. 8-9 show the actuation points of the suction valves 116 and the discharge valves 118 relative to the plunger-position reference points 502, 504, 602, 604. In some aspects, the graphs depicted in FIGS. 8-9 may be displayed on the display unit 212. The plunger-position reference points 502, 504, 602, 604 may correspond to an expected actuation point of the valves. In FIG. 8, the time distance between the actuation points 702, 704, 706, 708 and the plunger-position reference points 502, 504, 602, 604 may represent delays in the actuation (e.g., opening and closing) of the suction valve 116 and the discharge valve 118 for one chamber 106 of the pressure pump 100 from the expected actuation of the valves 116, 118. FIG. 8 shows the strain signal 700 representing strain measured by the strain gauge 204 for the chamber 106. The actuation points 702, 704, 706, 708 of the suction valve 116 and the discharge valve 118 in the chamber 106 are plotted at the discontinuities in the strain signal 700 as described with respect to FIG. 7. Additionally, the reference points 502, 504, 602, 604 representing the top dead center and bottom dead center of the plunger 114 are plotted. The time between the closing of the suction valve 116 (represented by actuation point 702) and the bottom dead center (represented by reference points 504, 604) may represent a delay in the closing of the suction valve 116. The time between the opening of the discharge valve 118 (represented by actuation point 704) and the bottom dead center (represented by reference points 504, 604) may represent a delay in the opening of the discharge valve 118. Similarly, the time between the closing of the discharge valve 118 (represented by actuation point 704) and the top dead center (represented by reference points 502, 602) may represent a delay in the closing of the discharge valve 118. And, the time or distance between the opening of the suction valve 116 (represented by actuation point 708) and the top dead center (represented by reference points 502, 602) may represent a delay in the opening of the suction valve 116.

In FIG. 9, the actuation points of the suction valve 116 and the discharge valve 118 are shown relative to the position of the plunger 114 for each chamber. The dual graph includes a compression side wherein the actuations of the valves 116, 118 are shown relative to the bottom dead center (represented by reference points 504, 604) of the plungers 114 and a decompression side wherein the actuations of the valves 116, 118 are shown relative to the top dead center (represented by reference points 502, 602) of the plunger 114. Actuation delays 900 are represented by the symbols on the y-axis for the distance of the actuation of each valve 116, 118 from the top dead center or the bottom dead center of the plunger 114 in each chamber. Although FIG. 9 shows the actuation delays 900 in linear distance corresponding to the movement of the plunger 114 in each chamber, the values may be similarly shown in units of degrees of rotation of the crankshaft 108 mechanically coupled to the plungers 114. On the compression side of the dual graph, symbols 902 (the lighter symbols having a higher-trending linear value) may represent the opening of the discharge valve 118 in each chamber 106 and symbols 904 (the darker symbols having a lower-trending linear value) may represent the closing of the suction valve 116 in each chamber 106. On the decompression side of the dual graph, symbols 906 (the lighter symbols having a higher-trending linear value) may represent the opening of the suction valve 116 in each chamber 106 and symbols 908 (the darker symbols having a lower-trending linear value) may represent the closing of the discharge valve 118 in each chamber 106. FIG. 9 shows the valves 116, 118 for multiple chambers 106 of the pressure pump 100. Different symbols may represent each chamber 106 (e.g., valves 116, 118 in a first chamber 106 may be represented by a circle, valves 116, 118 in a second chamber 106 may be represented by a diamond, etc.).

Although five chambers are represented, the monitoring subsystem 200 may monitor and determine actuation delays for valves 116, 118 in any number of chambers of the pressure pump 100, including one. In some aspects, the actuation delays for the valves 116, 118 may be transmitted by the monitoring subsystem 200 to a centralized computing device (e.g., centralized computing device 304 of FIGS. 3-4) for further analysis.

Figure 10:
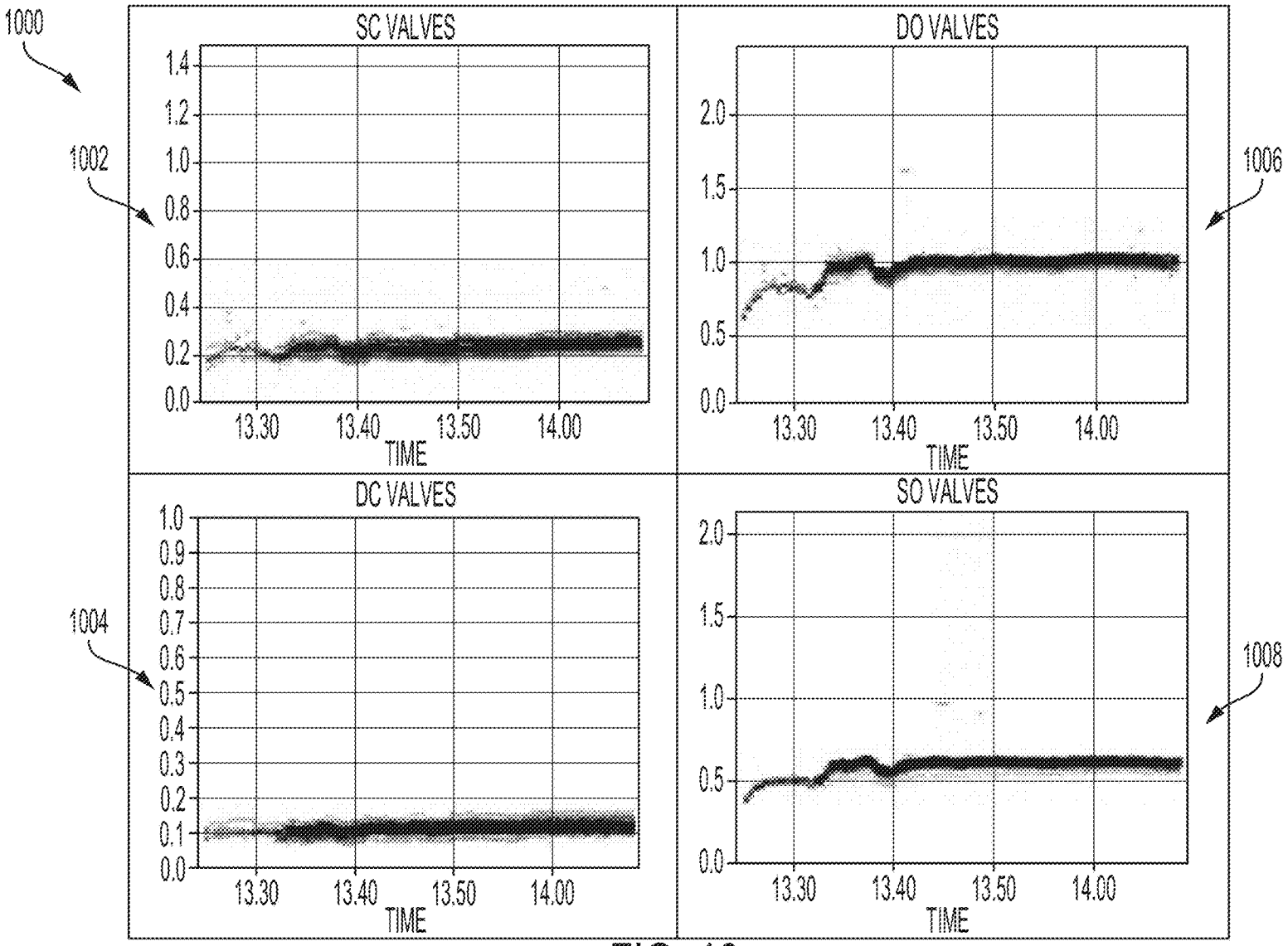
FIG. 10 is a composite plot graph depicting plot points representing actuation delays of suction valves and discharge valves in multiple pressure pumps in a multiple-pump wellbore environment according to one aspect of the present disclosure.
Figure 11:
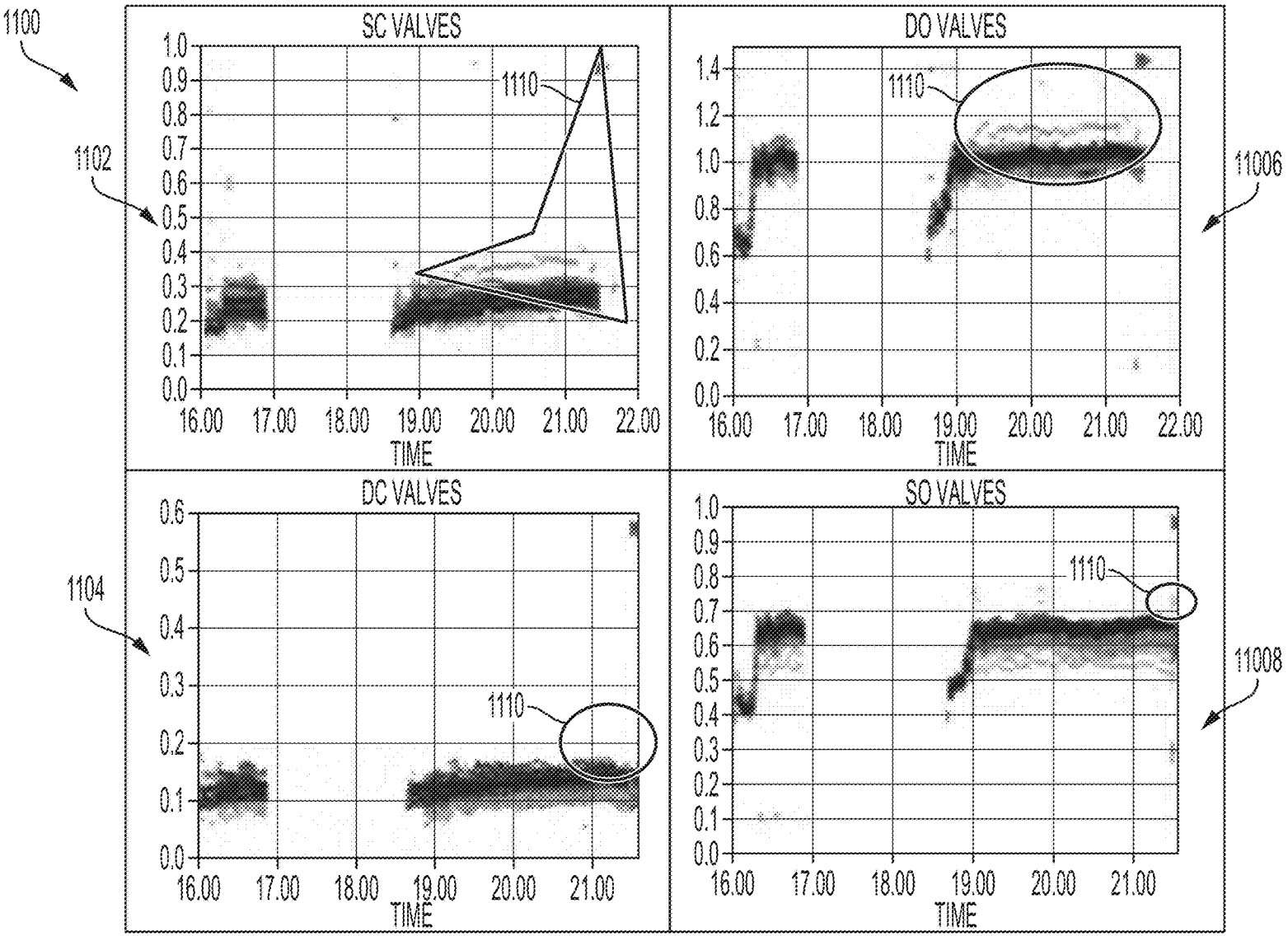
FIG. 11 is a composite graph depicting disparities in a trend of plot points representing actuation delays of suction valves and discharge valves in multiple pressure pumps in a multiple-pump wellbore environment according to one aspect of the present disclosure.

FIGS. 10-11 show actuation delays for suction valves 116 and discharge valves 118 in chambers 106 of multiple pressure pumps in a spread. FIG. 10 is a composite plot graph 1000 depicting a plot of actuation delays for 75 valves included in 15 different pressure pumps. Similar to the dual graph of FIG. 9, the actuation delays are represented by the dots on the y-axis for the distance of the actuation of each valve 116, 118 from the top dead center or the bottom dead center of the plunger 114 in each chamber of each of the pressure pumps. Graph 1002 represents a plot of the suction valves 116 in each of the chambers 106 of the multiple pressure pumps closing. Graph 1004 represents a plot of the discharge valves 118 in each of the chambers 106 of the multiple pressure pumps closing. Graph 1006 represents a plot of the discharge valves 118 in each of the chambers 106 of the multiple pressure pumps opening. Graph 1008 represents a plot of the suction valves 116 opening. In each of the graphs 1002, 1004, 1006, 1008, the plot points representing each valve of the pressure pumps in the spread follows along a similar trend indicating that the valves are operating under normal conditions without a noticeable issue.

FIG. 11 is a composite plot graph 1100 depicting a plot of the actuation delays for the suction valves 116 and the discharge valves 118 of FIG. 10 under an abnormal condition in the spread of pressure pumps according to one aspect of the present disclosure. Graph 1102 corresponds to the graph 1002 of FIG. 10 representing a plot of the suction valves 116 in each of the chambers 106 of the multiple pressure pumps closing. Graph 1104 corresponds to the graph 1004 of FIG. 10 representing a plot of the discharge valves 118 in each of the chambers 106 of the multiple pressure pumps closing. Graph 1106 corresponds to the graph 1006 of FIG. 10 representing a plot of the discharge valves 118 in each of the chambers 106 of the multiple pressure pumps opening. Graph 1108 corresponds to the graph 1008 of FIG. 10 representing a plot of the suction valves 116 opening. Discontinuities 1110 in the trend as indicated by the plot points corresponding to the actuation of the valves 116, 118 may represent an abnormal condition with respect to the outlier valve or valves having corresponding plot points falling outside of a range established by the trend. In some aspects, the abnormal condition may correspond to a problem with the valve, the chamber in which the valve is located, or the pump in which the valve is located. In additional and alternative aspects, the specific condition may be identified based on the pattern, level of disparity, or other visual indicator corresponding to the outlier valve with respect to the remaining valves on the composite plot graph 1100. For example, the discontinuities 1110 with respect to the suction valve 116 and the discharge valve 118 having a plot point out of the range of the remaining plot points may indicate a leak in the suction valve 116 leading to failure of the chamber 106 or pump 100.

Figure 12:
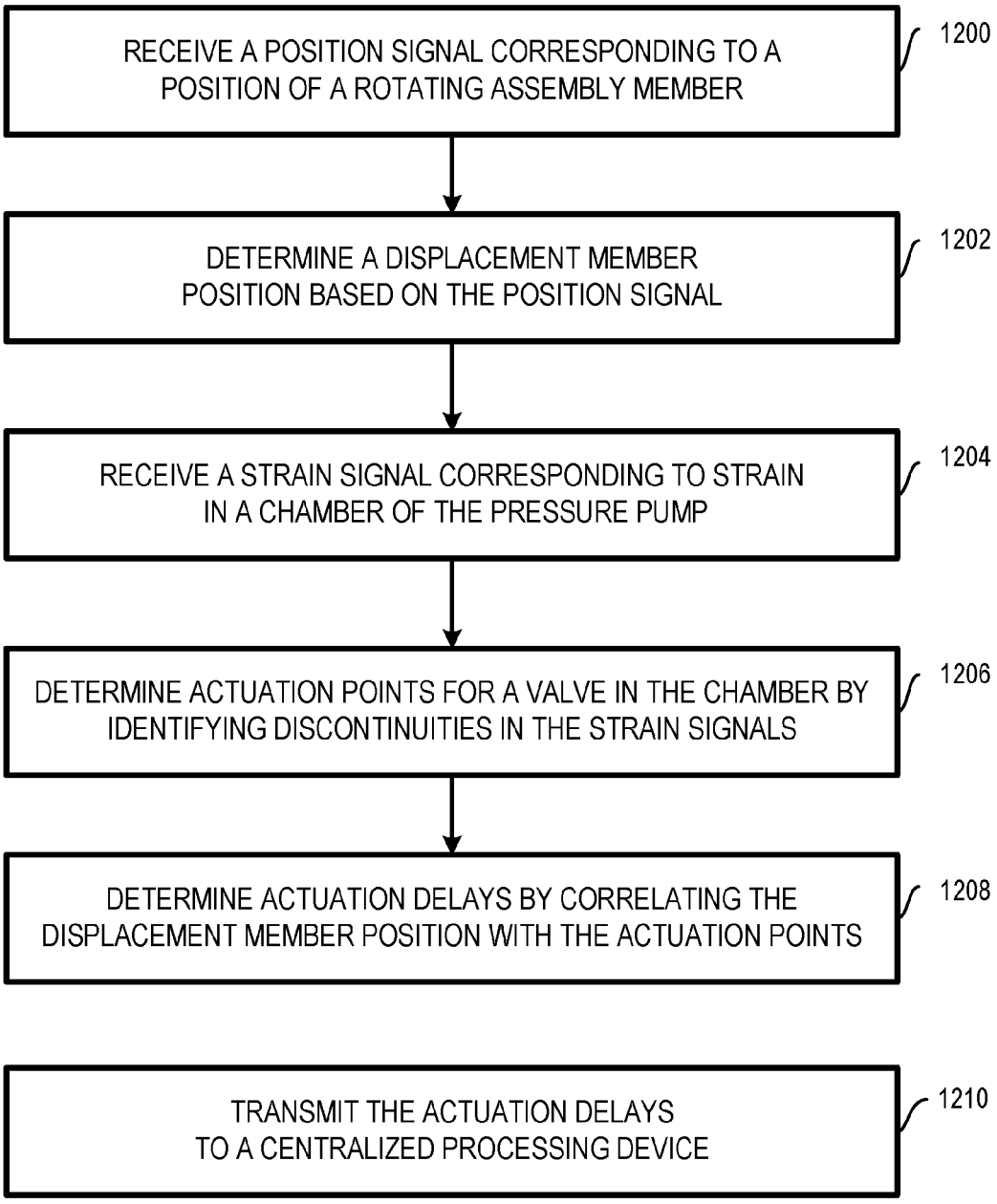
FIG. 12 is a flowchart of a process for determining actuation delays in a chamber of a single pressure pump according to one aspect of the present disclosure.
Figure 13:
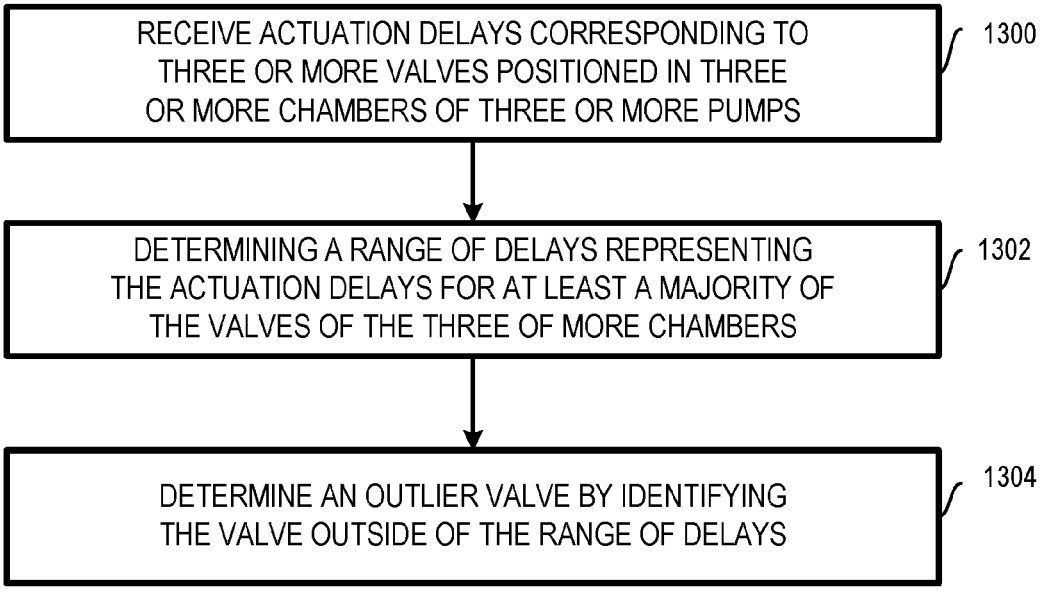
FIG. 13 is a flow chart of a process for determining a condition of a valve in a chamber of one of multiple pressure pumps according to one aspect of the present disclosure.

FIGS. 12-13 describe processes for monitoring valves in a multiple-pump wellbore environment. The processes are described with respect to FIGS. 1-11, unless otherwise indicated, though other implementations are possible without departing from the scope of the present disclosure.

FIG. 12 is a flow chart describing a process for determining actuation delays in a chamber of a single pressure pump according to one aspect of the present disclosure. In some aspects, the process may be implemented for each pressure pump in the multiple-pump wellbore environment.

In block 1200, a position signal 500, 600 may be received from the position sensor 202 in the pressure pump 100. The position signal 500, 600 may be received by the processor 208 of the computing device 206. In some aspects, the received signal may be similar to position signal 500 and may be received from the position sensor 202 sensing the position of a member of the rotating assembly (e.g., the crankshaft) 108 from a position proximate to the path of the rotating assembly as described with respect to FIG. 5. In other aspects, the received signal may be similar to position signal 600 and may be received from the position sensor 202 sensing the position of the crankshaft 108 from being positioned on a crankcase of the crankshaft 108 as described with respect to FIG. 6.

In block 1202, the processor 208 may determine the position of displacement members (e.g., the plungers 114) for at least one chamber 106 based on the position signal 500, 600. In some aspects, the plunger 114 may be mechanically coupled to the crankshaft 108 in a manner that the movement or position of the plunger 114 in the chamber 106 is directly related to the movement or position of the crankshaft 108 and in a manner that the plunger 114 operates in concert in the chamber 106. Based on the mechanical coupling of the crankshaft 108 and the plunger 114, the computing device 206 may determine plunger-position reference points 502, 504, 602, 604 corresponding to the position of the plunger 114 at various times during operation of the crankshaft 108 or pressure pump 100. For example, the computing device 206 may determine reference points 502, 504 representing the top dead center and bottom dead center positions of the plungers 114, respectively. In some aspects, the reference points 502, 504, 602, 604 may correspond to an expected actuation point of the valves of the chamber 106. For example, when the pressure pump 100 is operating in an ideal state, a valve of the chamber 106 may be expected to open at a top dead center of the plunger and close at a bottom dead center position of the plunger.

In block 1204, the processor 208 may receive a strain signal 700 from the strain gauge 204 for the chamber 106. The strain gauge 204 may be positioned on the fluid end 104 of the pressure pump 100 and generate a strain signal 700 corresponding to strain in the chamber 106 of the pressure pump 100. The strain signal 700 may represent a characterization of the strain in the chamber 106 as the suction valve 116 and the discharge valve 118 actuate (e.g., open or close) in response to the operation of the plunger 114 in the chamber 106.

In block 1206, the processor 208 determines the actuation points 702, 704, 706, 708 for the suction valve 116 and the discharge valve 118 in the chamber 106 of the pressure pump 100. In some aspects, the processor 208 may determine actuation points 702, 704, 706, 708 based on the discontinuities in the strain signal 700 as described with respect to FIG. 7. The actuation points 702, 708 may represent the closing and opening of the suction valve 116, respectively. The actuation points, 704, 706 may represent the opening and closing of the discharge valve 118, respectively.

In block 1208, the processor 208 determines actuation delays for the suction valve 116 or the discharge valve 118 in the chamber 106 based on the position of the respective plunger 114 and the respective actuation points 702, 704, 706, 708 of the valves 116, 118 for each chamber 106. The computing device 206 may correlate the reference points 502/602, 504/604 corresponding to the position of the plunger 114 (or other displacement member), and derived from the position signal 500/600, with the actuation points 702, 704, 706, 708 corresponding to the actuation of the suction valve 116 and discharge valve 118. The time or distance between the reference point 502/504 or the reference point 504/604 of the position of the plunger 114 and the actuation points 702, 704, 706, 708 may represent actuation delays corresponding to the opening and closing of the suction valve 116 and the discharge valve 118. The actuation delays may correspond to a delay between the expected actuation points of the valves 116, 118 represented by the position of the plunger via the reference points via the reference points 502, 504, 602, 604 and the actual actuation points of the valves 116, 118 determined in block 1206.

In block 1210, the processor 208 transmits the actuation delays for the suction valve 116 or the discharge valve 118 of the chamber 106 to the centralized processor 400. In some aspects, the processor 208 may transmit the actuation delays to the centralized processor 400 via the network 312. In additional and alternative aspects, the computing device 206 may include additional components (e.g., a network card, modem, etc.) through which the processor 208 may transmit the actuation delays to the centralized processor 400.

FIG. 13 is a flow chart describing a process for determining an abnormal condition of a valve in a chamber of one of multiple pressure pumps according to one aspect of the present disclosure.

In block 1300, the centralized processor 400 receives actuation delays corresponding to three or more valves 116, 118 in multiple pumps 304A, 304B, 304C coupled to the multiple-pump monitoring 300. In some aspects, the centralized processor 400 receives the actuation delays from the monitoring subsystems 302A, 302B, 302C corresponding to each of the multiple pumps 304A, 304B, 304C. For example, the monitoring subsystems 302A, 302B, 302C may determine the actuation delays for at least one valve 116. 118 in the corresponding pump 304A, 304B, 304C using the process described in FIG. 12.

In block 1302, a range of delays representing actuation delays for at least a majority of the valves corresponding to the actuation delays received by the centralized processor 400 is determined. In some aspects, to determine the range for the suction valves 116 or the discharge valves 118, the centralized processor 400 may execute instructions 404 to compare the actuation delays for similarly operating valves during similar actuations. For example, the centralized processor 400 may determine a range for discharge valve 118 openings in the pressure pump by comparing the actuation delays for each of the discharge valves 118 as they open (e.g., graphs 1006, 1106). The centralized processor 400 may similarly determine ranges for discharge valve 118 closings, suction valve 116 openings, and suction valve 116 closings by comparing the actuation delays for the corresponding valve actuations (e.g., graphs 1004/1104, graphs 1008/1108, and graphs 1002/1102, respectively). In some aspects, the ranges for a valve actuation may include the range of the majority of the actuation delays corresponding to the valve actuation. The range may represent the expected operation of the valves. In additional and alternative aspects, the ranges for a valve actuation may include a supermajority, or other amount larger than the majority.

In block 1304, an outlier valve or other means of determining a condition is determined by identifying the valve outside of the range of delays. The outlier valve may indicate a condition or issue in the chamber of the valve or a condition of the valve itself. If actuation are determined by the centralized processor 400 to fall outside of the range for the corresponding valve actuation, the centralized processor 400 may identify the valve 116, 118 corresponding to the actuation delay valve as an outlier valve. The deviation of the outlier valve may be identified in terms of having a statistical variation from the normal operation as determined by the range. The outlier valves may indicate a condition or issue within the first chamber 106 of the pressure pump 100.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A monitoring system, comprising:

a plurality of strain gauges positionable on a plurality of pressure pumps, each strain gauge of the plurality of strain gauges being positionable on a respective pressure pump of the plurality of pressure pumps to measure strain in a respective chamber of the respective pressure pump;

a plurality of position sensors positionable on the plurality of pressure pumps, each position sensor of the plurality of position sensors being positionable on the respective pressure pump of the plurality of pressure pumps to sense a position of a rotating member of a rotating assembly that is mechanically coupled to a displacement member for the respective chamber of the respective pressure pump;

one or more computing devices communicatively couplable to one or more pressure pumps of the plurality of pressure pumps, the one or more computing devices being configured to:

determine actuation delays associated with a plurality of valves located in the plurality of pressure pumps using expected actuation points and actual actuation points of the plurality of valves, wherein each valve of the plurality of valves is located in a separate pressure pump of the plurality of pressure pumps than other valves of the plurality of valves;

determine a range for the actuation delays associated with the plurality of valves, the range representing a trend of the actuation delays corresponding to a majority of the plurality of valves; and compare the actuation delays from each valve of the plurality of valves to determine a condition of a particular valve of the plurality of valves.

2. The monitoring system of claim 1, wherein the one or more computing devices includes a set of computing devices and a centralized computing device, wherein each computing device of the set of computing devices is communicatively couplable to a strain gauge of the plurality of strain gauges and a position sensor of the plurality of position sensors, and wherein the centralized computing device is communicatively couplable to the set of computing devices to receive the actuation delays associated with the plurality of valves and to determine the condition of the particular valve of the plurality of valves.

3. The monitoring system of claim 1, wherein at least one computing device of the one or more computing devices includes a processing device for which instructions executable by the processing device are usable to cause the processing device to determine the actual actuation points corresponding to an opening or closing of a respective valve of the plurality of valves in the respective chamber by identifying discontinuities in a strain signal generated by a strain gauge of the plurality of strain gauges and corresponding to the strain in the respective chamber.

4. The monitoring system of claim 3, wherein the instructions are further executable by the processing device to cause the processing device to determine the expected actuation points corresponding to an expected opening and closing of the respective valve by correlating a position signal generated by a position sensor of the plurality of position sensors and corresponding to the position of the rotating member with an expression representing a mechanical correlation of the displacement member to the rotating member to determine a position of the displacement member in the respective chamber that corresponds to the expected actuation points.

5. The monitoring system of claim 1, wherein at least one computing device of the one or more computing devices includes a processing device for which instructions executable by the processing device are usable to cause the processing device to determine a respective actuation delay associated with a respective valve of the plurality of valves by correlating the position of the displacement member in the respective chamber with an actuation point of the respective valve corresponding to an opening time or closing time of the respective valve.

6. The monitoring system of claim 1, wherein the one or more computing devices are further configured to identify an actuation delay falling outside of the range, the actuation delay corresponding to the particular valve and indicative of the condition of the particular valve.

7. A pumping system, comprising:

a plurality of pressure pumps having a plurality of valves, each pressure pump of the plurality of pressure pumps including:

a respective fluid chamber;

a respective valve corresponding to the respective fluid chamber, the respective valve being one of the plurality of valves and being actuatable at actuation points corresponding to an opening or a closing of the respective valve; and a displacement member corresponding to the respective fluid chamber, the displacement member being movable to displace fluid in the fluid chamber; and one or more computing devices communicatively coupled to the plurality of pressure pumps by a respective strain gauge and a respective position sensor corresponding to each pressure pump of the plurality of pressure pumps, the one or more computing devices being configured to:

determine actuation delays for the plurality of valves, the actuation delays being determined for each respective valve in each respective fluid chamber by using a strain signal corresponding to strain in the respective fluid chamber and a position signal corresponding to a position of a rotating member mechanically coupled to the displacement member;

determine a range for the actuation delays associated with the plurality of valves, the range representing a trend of the actuation delays corresponding to a majority of the plurality of valves; and compare the actuation delays for the plurality of valves of the plurality of pressure pumps to determine a condition of a particular valve in a pressure pump of the plurality of pressure pumps.

8. The pumping system of claim 7, wherein the respective strain gauge of each pump of the plurality of pressure pumps is positionable on an external surface of a respective fluid end of each pump to generate the strain signal corresponding to the strain in the respective fluid chamber of each pump, and wherein the one or more computing devices includes a processing device for which instructions executable by the processing device are usable to cause the processing device to determine the actuation points of the respective valve by identifying discontinuities in the strain signal.

9. The pumping system of claim 7, wherein the respective position sensor of each pump of the plurality of pressure pumps is positionable on an external surface of a respective power end of each pump to generate the position signal corresponding to the position of the rotating member of each pump, and wherein the one or more computing devices includes a processing device for which instructions executable by the processing device are usable to cause the processing device to determine a position of the displacement member by correlating the position of the rotating member and an expression representing a mechanical correlation of the rotating member to the displacement member.

10. The pumping system of claim 7, wherein the rotating member is a crankshaft, wherein the displacement member is a plunger, and wherein the position sensor is positionable on a crankcase of the crankshaft to determine a bolt pattern usable to determine the position of the plunger within the respective fluid chamber.

11. The pumping system of claim 7, wherein the one or more computing devices includes:

a set of computing devices corresponding to each pressure pump of the plurality of pressure pumps to determine the actuation delays for the respective valve of each pump by correlating a position of the displacement member within the respective fluid chamber and the actuation points for the respective valve; and a centralized computing device communicatively coupled to the set of computing devices to:

receive the actuation delays for the respective valve of each pump;

determine the condition of the particular valve in the pressure pump by determining the range for the actuation delays; and identify an actuation delay falling outside the range, the actuation delay corresponding to the particular valve and indicative of the condition of the particular valve.

12. The pumping system of claim 7, wherein the plurality of pressure pumps are fluidly couplable to each other by a manifold trailer positionable proximate to a wellbore to receive the fluid from the plurality of pressure pumps.

13. The pumping system of claim 7, wherein the plurality of valves including the respective valve for each pressure pump of the plurality of pressure pumps have a same type for performing a same operation in the respective fluid chamber of each pressure pump.

14. A method for monitoring valves in a plurality of pressure pumps, comprising:

for each respective pump of the plurality of pressure pumps, receiving from a position sensor coupled to a power end of the respective pump, a position signal representing a position of a member of a rotating assembly of the respective pump;

determining, by a processing device of a monitoring system, a position of a displacement member operable within a chamber of the respective pump using the position signal;

receiving, from a strain gauge coupled to an external surface of a fluid end of the respective pump, a strain signal representing strain in the chamber;

determining, by the processing device, actuation points corresponding to an opening or a closing of a respective valve in the chamber of the respective pump by identifying discontinuities in the strain signal;

determining, by the processing device, actuation delays for the respective valve by correlating the position of the displacement member within the chamber and the actuation points;

transmitting the actuation delays to a centralized processing device of the monitoring system, the centralized processing device being communicatively coupled to a plurality of processing devices corresponding to the plurality of pressure pumps;

receiving, by the centralized processing device of the monitoring system, the actuation delays corresponding to at least three valves of the plurality of pressure pumps;

determining, by the centralized processing device, a delay range representing the actuation delays corresponding to at least a majority of the at least three valves of the plurality of pressure pumps; and determining, by the centralized processing device, an outlier valve by identifying a particular valve of the at least three valves corresponding to an actuation delay outside of the delay range.

15. The method of claim 14, wherein the at least three valves are of a same type, the same type including one of a suction valve or a discharge valve, and wherein the actuation delays corresponding to the at least three valves represent a same action type, the same action type including one of a valve opening or a valve closing.

16. The method of claim 14, wherein determining the delay range representing the actuation delays includes identifying a trend in the actuation delays, and wherein identifying the particular valve corresponding to the actuation delay outside of the delay range includes determining that the particular valve is deviating from the trend.

17. The method of claim 14, wherein determining the position of the displacement member within the chamber of the respective pump includes correlating the position of the member of the rotating assembly of the respective pump and an expression representing a mechanical correlation of the member of the rotating assembly to the displacement member within the chamber of the respective pump.

18. The method of claim 14, wherein the strain gauge is positioned on the external surface of the fluid end, and wherein the position signal includes a bolt pattern generated by the position sensor positioned on a rotating surface of the power end, the bolt pattern representing the position of the position sensor as it rotates during operation of the respective pump.

19. The method of claim 14, wherein the plurality of pressure pumps are fluidly coupled to each other by a manifold trailer positioned proximate to a wellbore to receive fluid from the plurality of pressure pumps.

* * * * *